US005921187A

United States Patent [19]

Wang

[11] Patent Number: 5,921,187

[45] Date of Patent: Jul. 13, 1999

[54] PALLET STRUCTURE

[76] Inventor: Neng-Hsin Wang, No. 327, Chang Tsao Road, Chang Hua Hsien, Taiwan

[21] Appl. No.: 08/936,520

[22] Filed: Sep. 24, 1997

[51] Int. Cl.[6] ..... B65D 19/00

[52] U.S. Cl. ..... 108/51.3; 108/56.3

[58] Field of Search ..... 108/51.3, 56.1, 108/56.3, 51.11

[56] References Cited

U.S. PATENT DOCUMENTS

| | | | |
|---|---|---|---|
| 2,444,183 | 6/1948 | Cahners | 108/51.3 |
| 2,957,668 | 10/1960 | Norquist et al. | 108/51.3 |
| 3,026,015 | 3/1962 | Severn | 108/51.3 X |
| 3,026,078 | 6/1962 | Simkins | 108/51.3 |
| 3,911,834 | 10/1975 | Quaintance | 108/51.3 |
| 4,303,020 | 12/1981 | Houle | 108/51.3 |
| 4,326,467 | 4/1982 | Schleicher et al. | 108/56.1 X |
| 4,759,295 | 7/1988 | Nilsen et al. | 108/51.3 |
| 4,863,024 | 9/1989 | Booth | 108/51.3 X |
| 5,377,600 | 1/1995 | Speese et al. | 108/51.3 |

FOREIGN PATENT DOCUMENTS

| | | | |
|---|---|---|---|
| 2061871 | 5/1981 | United Kingdom | 108/51.3 |

*Primary Examiner*—Jose V. Chen
*Assistant Examiner*—Hanh V. Tran
*Attorney, Agent, or Firm*—Smith, Gambrell & Russell, LLP; Beveridge, DeGrandi, Weilacher & Young; Intellectual Property Group

[57] ABSTRACT

A pallet structure includes a rectangular paper blank folded to define a first side stringer, a second side stringer, and a central stringer. This paper blank includes: (a) a first folding line adjacent to a first end portion of the paper blank, wherein the first folding line defines a first folding flap, (b) a second folding line adjacent to a second end portion of the paper blank, wherein the second folding line defines a second folding flap, (c) a first set of four folding lines, including a third folding line, a fourth folding line, a fifth folding line, and a sixth folding line, located between the first and second folding lines, wherein the first set of four folding lines defines a third folding flap, a fourth folding flap, and a fifth folding flap, and (d) a second set of four folding lines, arranged symmetric to the first set of four folding lines with respect to a center of the paper blank, wherein the second set of four folding lines includes a seventh folding line, an eighth folding line, a ninth folding line, and a tenth folding line, and wherein the second set of four folding lines defines a sixth folding flap, a seventh folding flap, and an eighth folding flap. When the paper blank is folded, the first and second folding flaps are spaced apart from one another and define the central stringer, the third, fourth, and fifth folding flaps define the first side stringer, and the sixth, seventh, and eighth folding flaps define the second side stringer. Additionally, a plurality of elongated stuffing boards are provided in each of the central stringer, the first side stringer, and the second side stringer.

1 Claim, 5 Drawing Sheets

PALLET STRUCTURE

FIELD OF THE INVENTION

The present invention relates to an improved pallet structure of the type which is folded from a paper blank that has a rectangular shape, wherein the paper blank is provided with a plurality of folding lines adjacent to its end portions which define a pair of folding flaps. The paper blank further is symmetrically provided with two sets of four folding lines that symmetrically define two sets of three folding flaps. The width of the outmost folding flap is equal to the width of the outer one of the three folding flaps, while the widths of the other two of the three folding flaps are equal to one another. When folded, each set of three folding flaps jointly constructs a side stringer, and a central stringer is defined by the end folding flaps, which are spaced apart from each other. The central and the side stringers are filled with a plurality of elongated stuffing boards respectively. When the pallet is produced from the paper blank, there is no waste, and the formation of the pallet from the paper blank can be quickly and readily conducted.

DESCRIPTION OF THE PRIOR ART

Pallets made from paper board have become more and more popular. However, pallets made from wood boards and stringers are still used since wooden pallets may sustain heavier loads than paper pallets. On the other hand, wooden pallets have rugged surfaces, and the wooden boards and stringers are attached to each other with metal nails. This engagement, however, is not durable when the wooden pallet is lifted by a forklift or crane, as the wooden boards and stringers are easily broken. Furthermore, the fingers of the operator may be readily injured by the rugged surface and/or projected nails of the wooden pallet.

Known pallets made from paper boards, while they may have an identical shape to wooden pallets, typically do not have sufficient strength and rigidity. Even if the paper stringers have excellent strength, the load-sustaining board may be supported only around the stringers. The load-sustaining board located between two adjacent stringers is not well supported, and it tends to deflect or bend when external loads are applied. This deflection is inevitable.

Other problems are encountered when entrances for the fork of a forklift are cut or evacuated from a whole and thick paper block which is configured from a plurality of paper boards. As a result, there is much waste material formed during the manufacturing process of the paper pallet. Not only will this waste increase the manufacturing cost, but it will also increase the inconvenience of disposing of the waste material. This inconvenience makes users continue to select wooden pallets instead of paper pallets. This is really a great loss to the paper pallet industry.

SUMMARY OF THE INVENTION

It is the objective of this invention to provide an improved pallet structure of the type which is made from a folded paper blank. The pallet made therefrom is free from any waste material.

In order to achieve the objective set forth, an improved pallet structure of the type that is folded from a rectangular paper blank is provided. The paper blank is provided with a plurality of folding lines adjacent to the end portions of the blank, wherein a pair of folding flaps are defined respectively by these folding lines. The paper blank is further symmetrically provided with two sets of four folding lines which define two sets of three folding flaps. The width of the outmost folding flap is equal to the width of the outer one of the three folding flaps, while the widths of the other two of the three folding flaps are equal to each other. In this manner, when folded, each set of three folding flaps jointly constructs a side stringer (such that a pair of side stringers are produced), while a central stringer is defined by the outmost folding flaps, which are spaced apart from each other. The central and the side stringers are filled with a plurality of elongated stuffing boards, respectively. When the pallet is produced from the paper blank, there is no waste, and the formation of the pallet from the paper blank can be quickly and readily conducted.

According to another aspect of the present invention, a paper blank is rolled with: (a) four folding lines which are transverse to the longitudinal direction of the paper blank, such that three folding flaps are formed between adjacent folding lines, and (b) three folding lines at each side, such that another three folding flaps are formed. In this embodiment, the folding flaps located at the far ends are wider than those in the center. When the paper blank is folded along the folding lines, U-shaped central and side stringer portions are formed, and a plurality of elongated stuffing boards are filled into each of the central and side stringer portions to increase the rigidity thereof. Then, a covering paper board is attached such that the openings of the U-shaped central and side stringer portions are completely enclosed to form a planar upper surface. Again, in this embodiment, no waste is formed during the manufacturing process which is simple, fast, and cost effective.

Still according to another aspect of the present invention, a pallet is formed from a first paper blank and a second paper blank which can be attached to the first paper blank. The first paper blank has a rectangular shape, which is rolled to form three folding lines adjacent to both ends such that three folding flaps are respectively formed at each end. The width of the outmost folding flap is less than the width of the inner folding flaps, and the width of the outmost folding flap is equal to the width of the folding flaps of the second paper blank. The second paper blank also has a rectangular shape, and the central portion thereof is rolled to form four folding lines such that three folding flaps are formed therein. When each of the folding lines and flaps are formed, the first paper blank is folded to form two L-shaped side stringer portions, and the second paper blank is folded along the folding lines to form an U-shaped central stringer portion. A plurality of elongated stuffing boards can be filled into the central stringer portion to increase the rigidity of the central stringer, the elongated stuffing boards being interconnected with the inner wall of the folding flaps. Also, a plurality of elongated stuffing boards can be filled into the side stringer portions to increase the rigidity of the side stringer portions, the elongated stuffing boards being interconnected with the inner wall of the folding flaps. In this embodiment, the width of one folding flap of the first paper blank is larger than the other folding flaps, such that a gap will be formed between the top of the elongated stuffing boards and the top surface of the first paper blank. The thickness of the gap is made equal to the thickness of the second paper blank such that an end portion of the second paper blank can be inserted and retained within the gap. Again, with this embodiment, during the manufacturing process, there is no waste left, and the manufacturing process is simple, fast, and cost effective.

BRIEF DESCRIPTION OF THE DRAWINGS

In order that the present invention may be more readily understood, the following description is given, merely by way of example, with reference to the accompanying drawings, in which.

DETAILED DESCRIPTION OF THE PREFERRED EMBODIMENT

Figure 1:
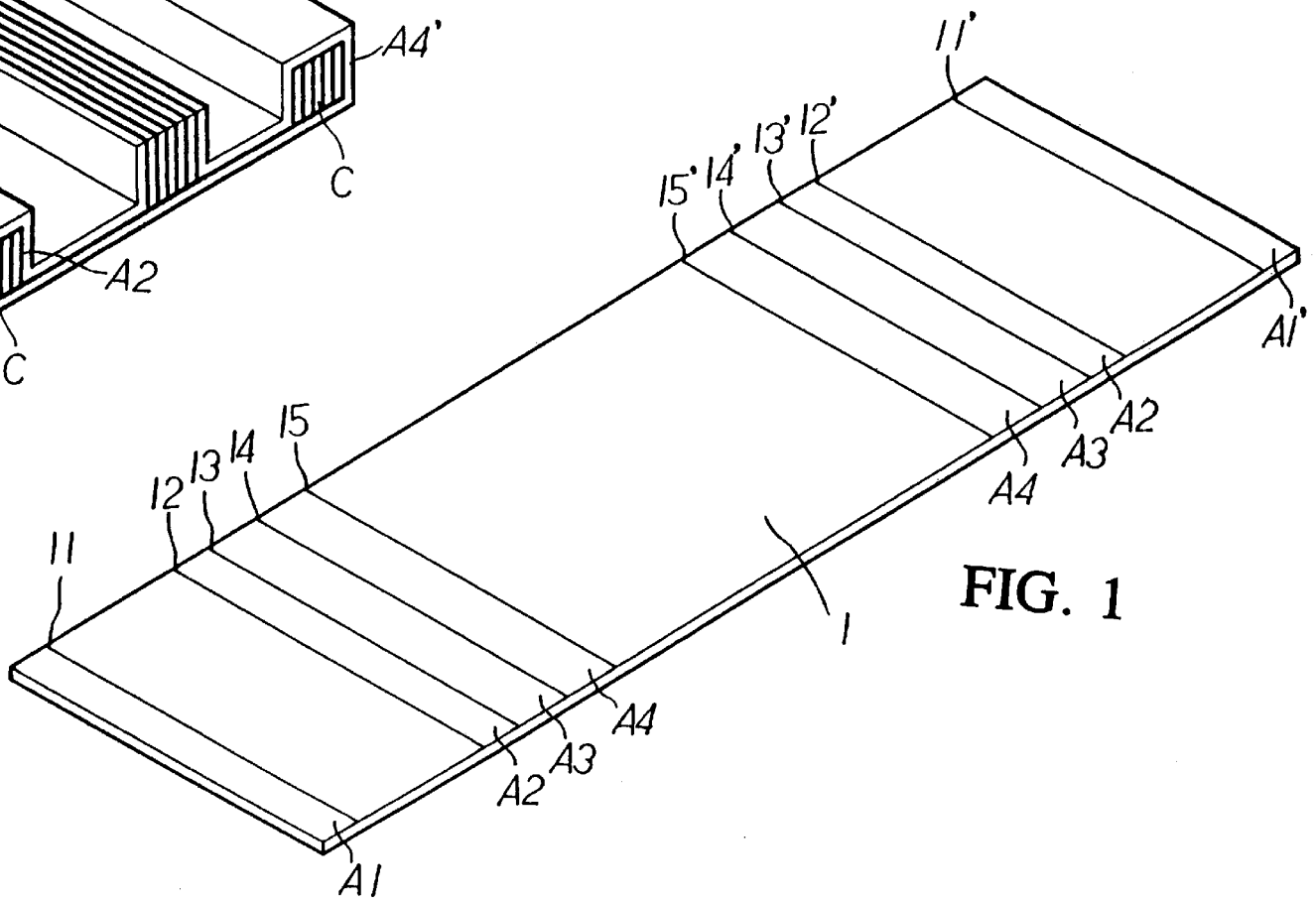
FIG. 1 is a layout of a paper blank according to a first embodiment of the invention before forming a pallet therefrom.
Figure 2:
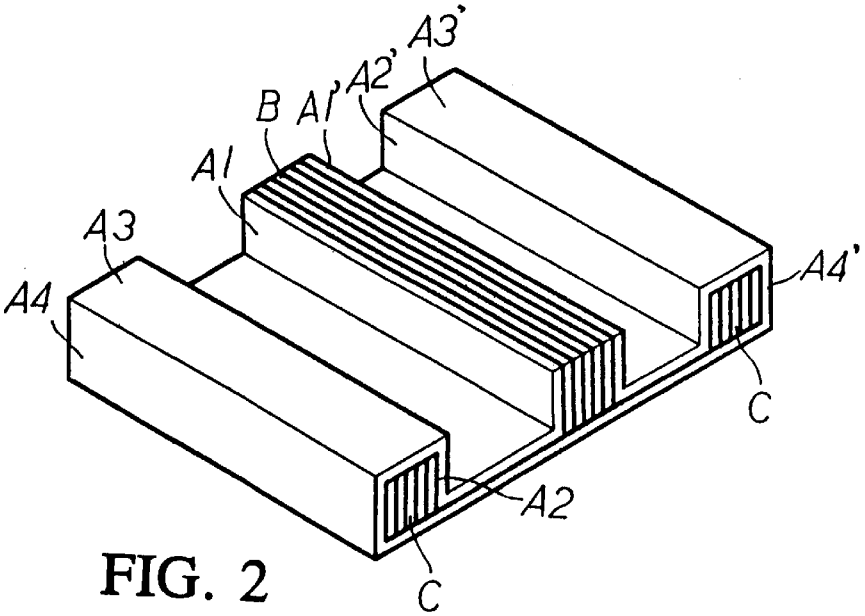
FIG. 2 is a perspective view of the pallet formed from the paper blank shown in FIG. 1.

Referring to FIGS. 1 and 2, the improved pallet structure is made from a paper blank without generating any waste. The improved pallet is folded from a paper blank 1 which has been selectively provided with folding lines. When the paper blank 1 is folded along the folding lines, the side stringers and central stringer can be readily formed.

The paper blank 1 has a rectangular shape and is provided with a plurality of folding lines 11, 11' adjacent to the end portions and which are transverse to the longitudinal direction of the paper blank 1. A pair of folding flaps A1, A1' are defined respectively by folding lines 11, 11', and each of these folding flaps A1 and A1' have the same width. The paper blank 1 also is symmetrically provided with eight folding lines 12, 12', 13, 13', 14, 14', 15, and 15', which symmetrically define three pair of folding flaps A2, A2', A3, A3', A4 and A4' between adjacent folding lines. The width of the folding flaps A1, A1', A2, and A2' are equal to each other, while the width of folding flaps A3, A3', A4, and A4' are wider than the width of folding flaps A1, A1', A2, and A2'. Each adjacent set of three folding flaps A2, A3, and A4 and A2', A3', and A4' are jointly constructed to form the side stringers, and the folding flaps A1 and A1' jointly define the central stringer. The central and side stringers have the same height and are spaced with a preset distance. Once formed, the pallet has a planar bottom surface. The central stringer can be filled with a plurality of elongated stuffing boards B which are interconnected with each other with adhesives. The side stringers can also be filled with a plurality of elongated stuffing boards C which are interconnected with each other with suitable adhesives. When the pallet is produced from the paper blank 1, there is no waste. Furthermore, the formation of the pallet from the paper blank 1 can be quickly and readily conducted.

Figure 3:
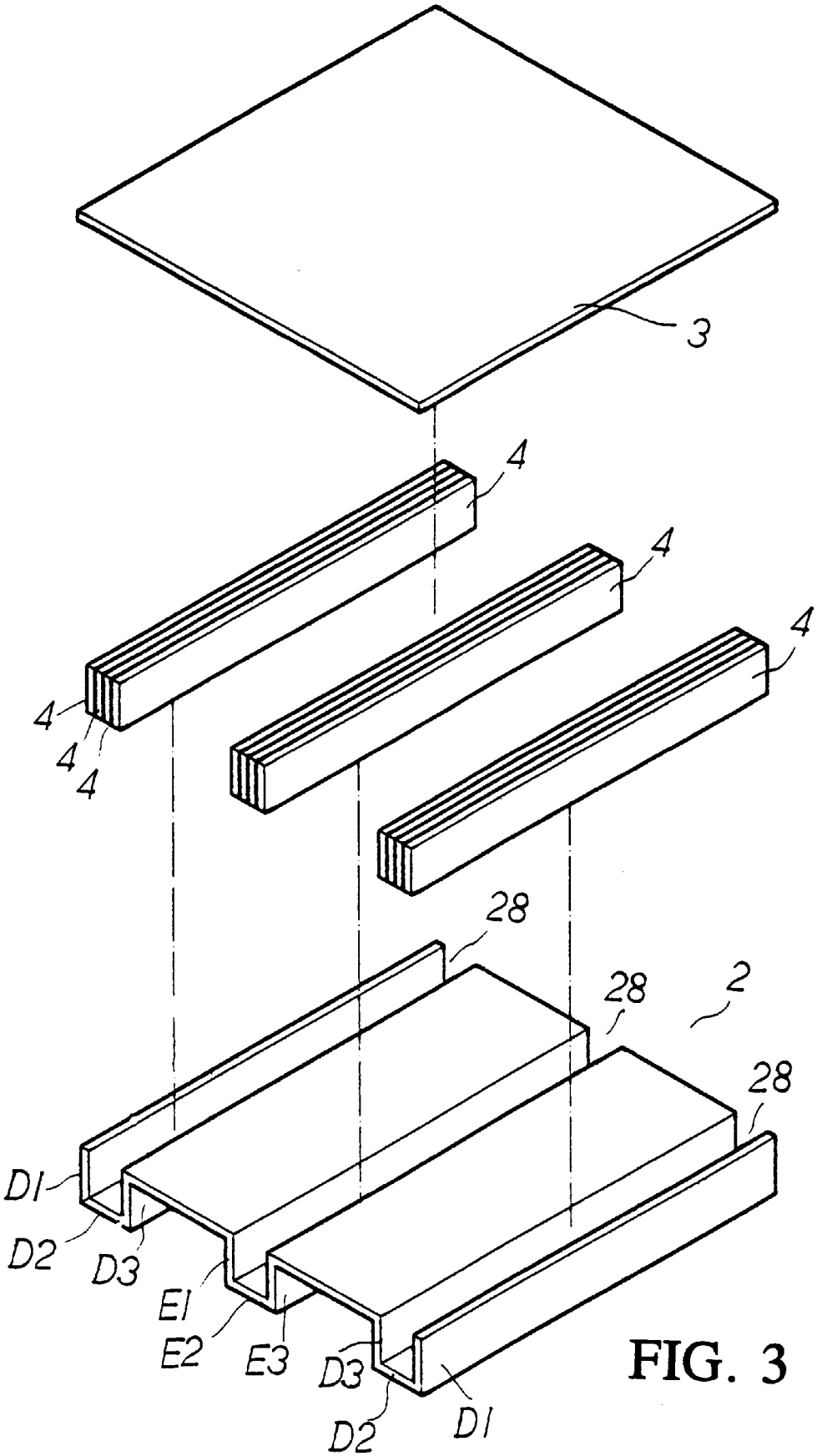
FIG. 3 is an exploded perspective view of another embodiment of a pallet according to the invention.
Figure 4:
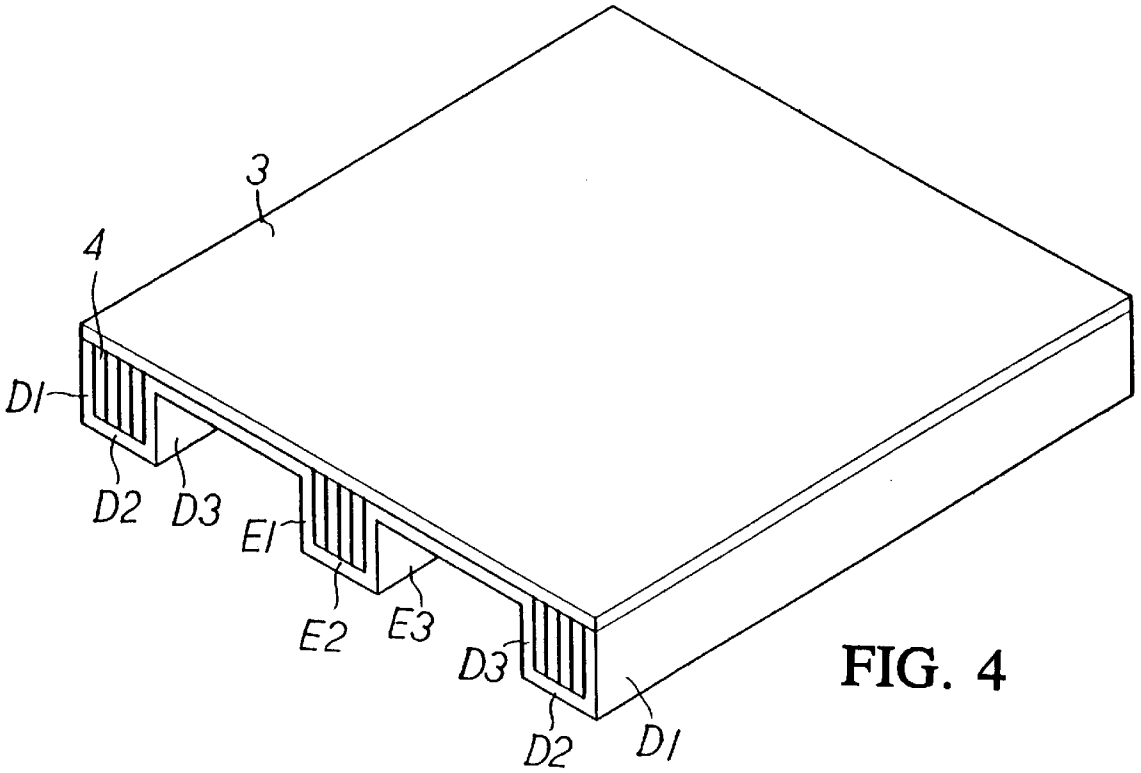
FIG. 4 is a perspective view of the pallet shown in FIG. 3.
Figure 5:
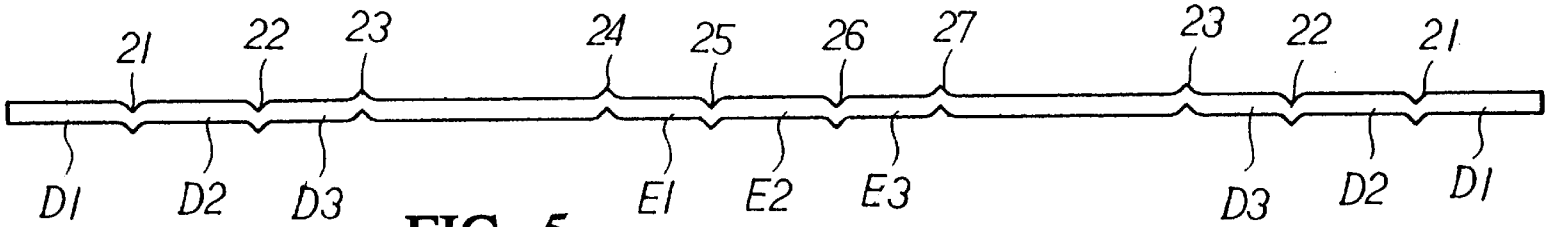
FIG. 5 is a side elevational view of the paper blank used to form the pallet shown in FIG. 3.

Referring to FIGS. 3, 4, and 5, another paper blank for configuring a pallet is disclosed. The pallet is configured from a paper blank 2 having a plurality of folding lines for defining a plurality of folding flaps therebetween, a covering paper sheet 3, and elongated stuffing boards 4.

The paper blank 2 has a rectangular configuration and is selectively provided with two sets of three folding lines 21, 22 and 23. After the folding lines 21, 22 and 23 are folded, three folding flaps D1, D2 and D3 are formed, wherein the width of folding flap D1 is wider than that of folding flaps D2 and D3. Another set of folding lines 24, 25, 26 and 27 are also formed transverse to the longitudinal direction of the paper blank 2. In the same manner, three folding flaps E1, E2 and E3 are also formed between adjacent folding lines 24, 25, 26 and 27. When the paper blank 2 is folded along the predetermined folding lines, the central and side stringer portions are respectively formed.

A plurality of elongated stuffing boards 4 are filled into the central and side stringer portions, the stuffing boards being interconnected with each other and with the folding flaps by adhesives. By this arrangement, the central and side stringers are provided with excellent rigidity for sustaining loads.

The covering paper sheet 3 is specially sized to readily cover the top surface of the pallet such that when the paper sheet 3 covers the paper blank 2, the opening 28 of each of the stringer portions can be readily enclosed. As a result, the pallet is provided with a planar and even top surface.

In the manufacturing process, the paper blank 2 is firstly folded along the folding lines 21, 22, 23, 24, 25, 26 and 27 such that the central and side stringer portions are formed. The covering paper board 3 is covered onto the top of the folded paper blank 2 such that the opening 28 of the central and side stringer portions are completely enclosed. The covering paper board 3 is then interconnected with the inner side walls of the folding flaps E1, E3, D1 and D3 with adhesives. Afterward, a plurality of elongated stuffing boards 4 are stuffed into the side and central stringer portions to increase the rigidity of the stringer portions. In this manner, an improved pallet is configured. From the foregoing description, it can be readily appreciated that only a simple rolling process for forming a plurality of folding lines onto a paper blank is required. The elongated stuffing board does not need to be involved in the manufacturing process. As a result, the manufacturing process as well as labor hours can be significantly reduced. The manufacturing cost is also advantageously lowered.

Figure 6:
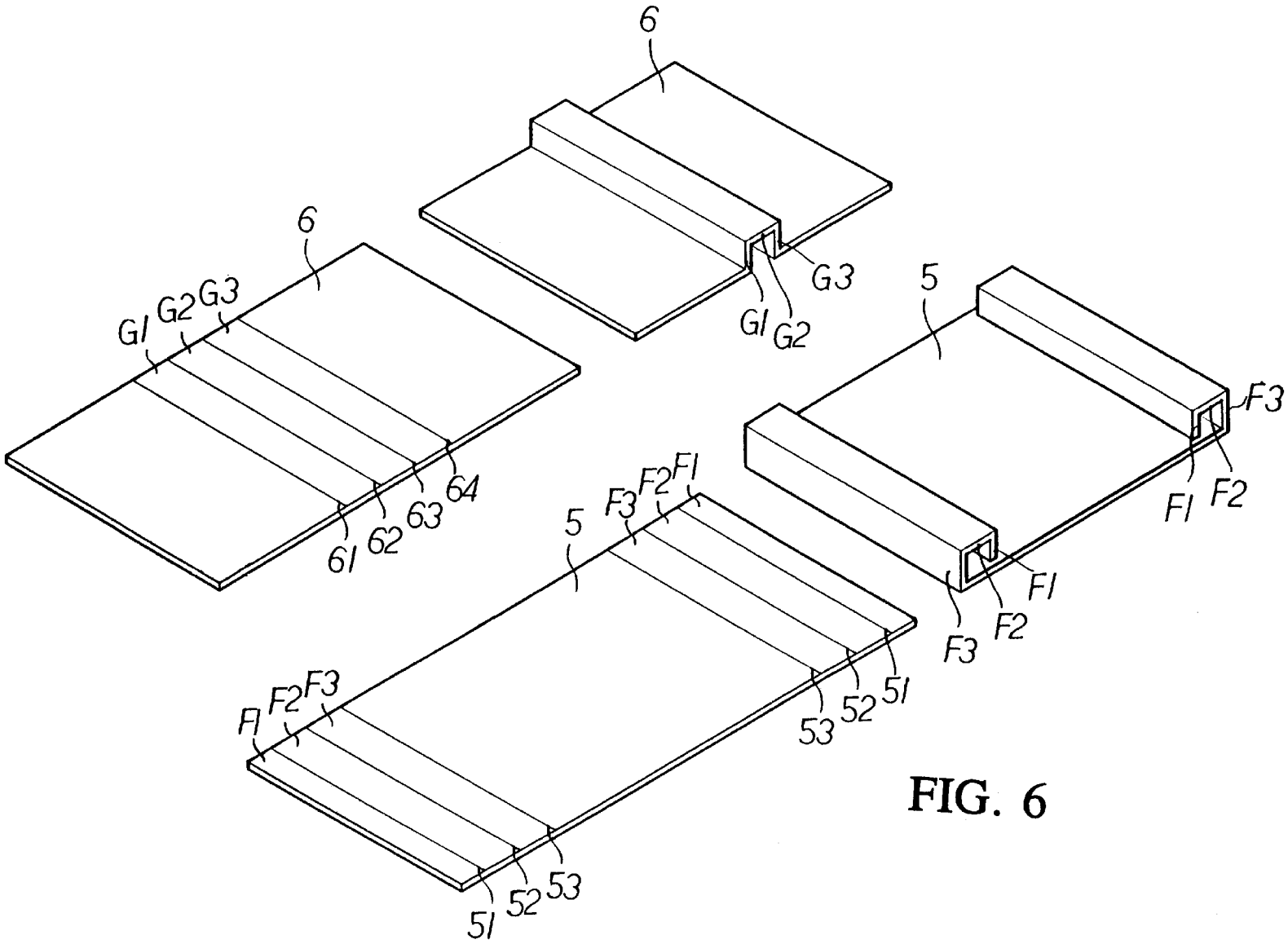
FIG. 6 is an exploded perspective view of a third embodiment of a pallet according to the invention.
Figure 7:
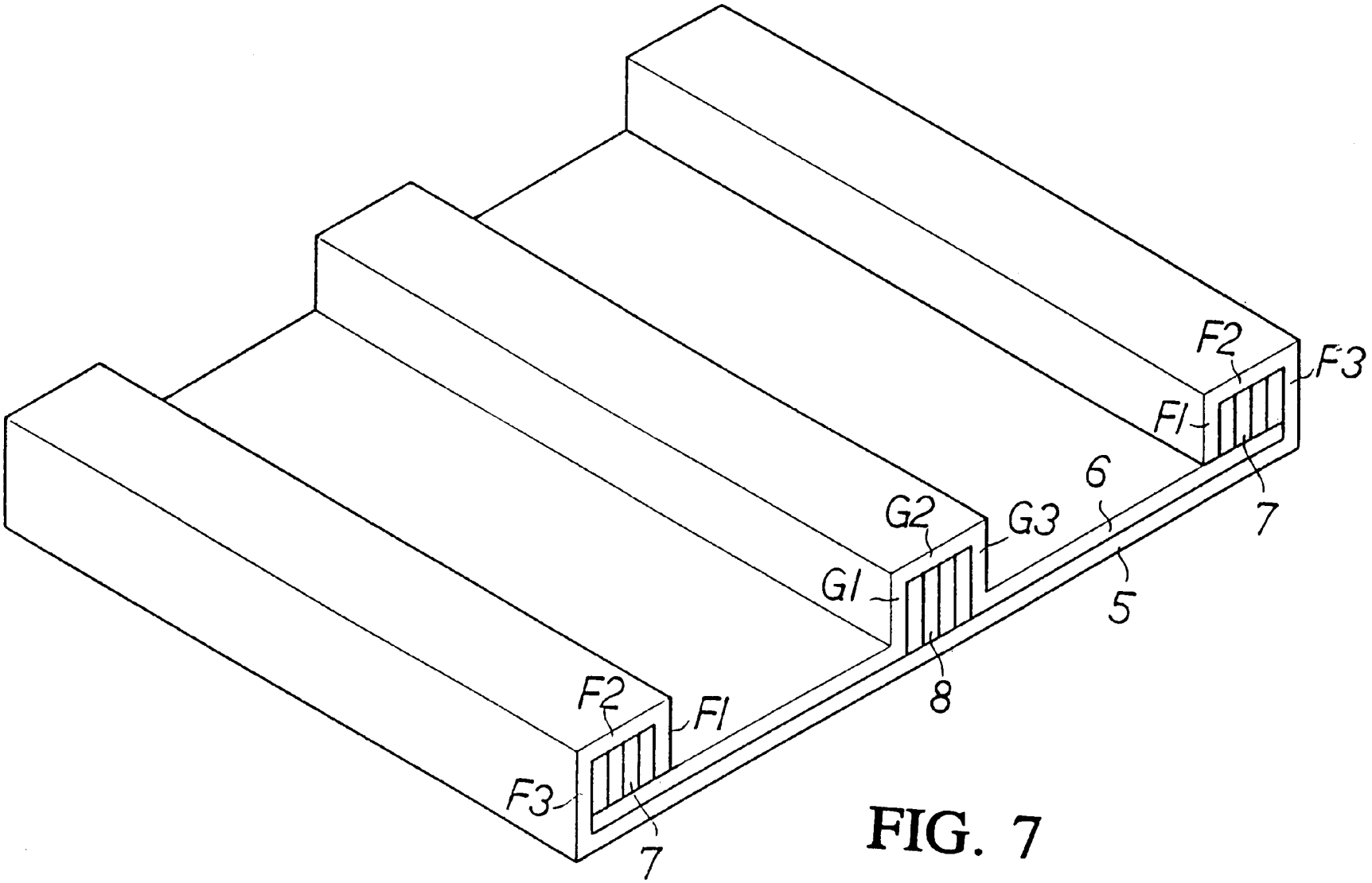
FIG. 7 is a perspective view of the third embodiment of the pallet shown in FIG. 6.

Referring to FIGS. 6 and 7, an alternative for making a pallet from a paper blank is disclosed. In this embodiment, the pallet is formed from a first paper blank 5 and a second paper blank 6 which can be attached to the first paper blank 5.

The first paper blank 5 has a rectangular shape, which is rolled to form two sets of three folding lines 51, 52 and 53, one set adjacent to each end such that three folding flaps F1, F2 and F3 are respectively formed at the ends. The width of the outmost folding flap F1 is less than the width of the inner folding flaps F2 and F3. However, the width of folding flap F1 is equal to the width of folding flaps G1, G2 and G3 to be formed in the second paper blank 6.

The second paper blank 6 has a rectangular shape, and the central portion is rolled with four folding lines 61, 62, 63 and 64 such that three folding flaps G1, G2 and G3 are formed. The folding flaps G1, G2 and G3 have equal width.

When each of the folding lines and flaps are formed, the first and second paper blanks 5 and 6 can be folded to form the side and central stringer portions, respectively. When the second paper blank 6 is folded along folding lines 61, 62, 63, and 64, an U-shaped central stringer portion will be formed from the folding flaps G1, G2 and G3. Then, a plurality of elongated stuffing boards 8 can be filled into the central stringer portion to increase the rigidity of the central stringer. The elongated stuffing boards 8 are interconnected with the inner wall of the folding flaps G1 and G3.

Moreover, the first paper blank 5 is folded along the folding lines 51, 52 and 53 such that a pair of L-shaped side stringer portions are formed by the folding flaps F1, F2 and F3. When these two L-shaped side stringer portions are formed, a plurality of elongated stuffing boards 7 are filled into the stringer portions to increase the rigidity of the side stringer portions. The elongated stuffing boards 7 are interconnected with the inner wall of the folding flaps F1 and F3. Because the width of folding flap F3 is larger than that of folding flap F1, a gap will be formed between the top of the elongated stuffing boards 7 and the top surface of the first paper blank 5. The thickness of the gap is equal to the thickness of the second paper blank 6 such that the end portion of the second paper blank 6 can be inserted and retained within the gap. When the end portions of the second paper blank 6 are inserted, they can be deployed with adhesives such that the second paper blank 6 can be fixedly attached to the first paper blank 5. As is apparently, there is no waste left after the manufacturing process.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A pallet structure, comprising:

a rectangular paper blank folded so as to define a first side stringer, a second side stringer, and a central stringer between the first side stringer and the second side stringer, wherein the paper blank includes:

a first folding line adjacent to a first end portion of the paper blank, wherein the first folding line defines a first folding flap located at the first end portion, a second folding line adjacent to a second end portion of the paper blank, wherein the second folding line defines a second folding flap located at the second end portion, a first set of four folding lines, including a third folding line, a fourth folding line, a fifth folding line, and a sixth folding line, located between the first folding line and a center of the paper blank, and wherein the first set of four folding lines defines a third folding flap, a fourth folding flap, and a fifth folding flap, a second set of four folding lines, arranged symmetric to the first set of four folding lines with respect to the center of the paper blank, wherein the second set of four folding lines includes a seventh folding line, an eighth folding line, a ninth folding line, and a tenth folding line, and wherein the second set of four folding lines defines a sixth folding flap, a seventh folding flap, and an eighth folding flap, wherein a width of the first folding flap is equal to a width of the third folding flap, wherein a width of the second folding flap is equal to a width of the sixth folding flap, wherein a width of the fourth folding flap is equal to a width of the fifth folding flap, and wherein a width of the seventh folding flap is equal to a width of the eighth folding flap, and wherein, when the paper blank is folded, the first and second folding flaps are spaced apart from one another and define the central stringer, the third, fourth, and fifth, folding flaps define the first side stringer, and the sixth, seventh, and eighth folding flaps define the second side stringer; and a plurality of elongated stuffing boards provided in each of the central stringer, the first side stringer, and the second side stringer.

* * * * *